US006502332B1

(12) United States Patent
Nakayama

(10) Patent No.: US 6,502,332 B1
(45) Date of Patent: Jan. 7, 2003

(54) SPIKE FOR GOLF SHOES

(75) Inventor: Hiroshi Nakayama, Osaka (JP)

(73) Assignees: Yugenkaisha Maruzen Byora, Osaka (JP); Yugenkaisha Shinjo Seisakusho, Osaka (JP)

( * ) Notice: Subject to any disclaimer, the term of this patent is extended or adjusted under 35 U.S.C. 154(b) by 24 days.

(21) Appl. No.: 09/705,693

(22) Filed: Nov. 6, 2000

(30) Foreign Application Priority Data

Nov. 8, 1999 (JP) ..... 11-316275

(51) Int. Cl.[7] ..... A43B 5/00
(52) U.S. Cl. ..... 36/134; 36/59 R; 36/127
(58) Field of Search ..... 36/134, 127, 67 R, 36/67 A, 67 B, 67 D, 59 R, 59 A, 59 C, 61–62

(56) References Cited

U.S. PATENT DOCUMENTS 167,239 A * 8/1875 Guilford ..... 36/67 D
4,014,114 A * 3/1977 Jordan et al. ..... 36/67 D
4,063,372 A * 12/1977 MacNeill ..... 36/127
4,193,216 A * 3/1980 Ueda ..... 36/67 D
5,027,532 A * 7/1991 MacNeil et al. ..... 36/134
5,029,405 A * 7/1991 DeHaitre ..... 36/134
5,426,873 A * 6/1995 Savoie ..... 36/127
5,711,515 A * 1/1998 Nishimura ..... 269/276
6,006,454 A * 12/1999 Sitzler, Sr. ..... 36/127
6,012,239 A * 1/2000 Conway et al. ..... 36/134
6,023,860 A * 2/2000 McMullin ..... 36/127
6,182,379 B1 * 2/2001 Savage ..... 36/62
6,327,797 B1 * 12/2001 Deacon et al. ..... 36/127

* cited by examiner

*Primary Examiner*—Mickey Yu
*Assistant Examiner*—Jila M. Mohandesi
(74) *Attorney, Agent, or Firm*—Antonelli, Terry, Stout & Kraus, LLP.

(57) ABSTRACT

A spike (1) for golf shoes has a base plate (2) formed of a quench-hardened metal plate and having a concave upper face to be fixed on a shoe-sole, the base plate (2) being of a dish-washer-like shape. The base plate has a periphery formed integral with a plurality of tooth-shaped lugs (3) that are disposed at regular angular intervals and bent downwards. The spike further has a fastenable columnar member (4) having a male-threaded shank and protruding from a central part of the base plate. The tooth-shaped lugs (3) are tapered downwards and outwards relative to the base plate.

6 Claims, 5 Drawing Sheets

SPIKE FOR GOLF SHOES

BACKGROUND OF THE INVENTION

The present invention relates to a spike which is fixedly secured to the sole of golf shoes.

The prior art spikes made of a metal and comprising individual spike pins have often damaged the putting green. Particularly in recent years, an increase in the number of golf players has brought about serious injury on each lawn. Therefore, many golf courses now oblige players to wear the so-called 'soft-spikes' in order to protect the putting green. A body of the soft-spike is generally made of a metallic material, which includes a male-threaded shank as an attachment to a shoe-sole. The body of the soft-spike is formed integral with a base plate by injection molding. The base plate has a plurality of short lugs (see for example the Japanese Patent Publication No. 6-104081, or the Japanese Utility Model Publication No. 3027022).

The soft-spikes are inferior to the metal ones in ground-gripping force. In addition, an end portion of each soft-spike is deficient in abrasion-resistance and durability because its body is made of a plastics. Particularly, abraded spikes will give rise to unsatisfactory shots, so that golf players need to renew their spikes frequently, thus problematically causing them much labor and expense.

SUMMARY OF THE INVENTION

The present invention was made in view of the deficiency in the prior proposal. An object of the invention is therefore to provide a metal spike for golf shoes that excels in abrasion-resistance and durability. Another object of this invention is to provide a spike which can firmly engage the ground tightly and yet to prevent the putting green from being injured.

In order to achieve these objects, the spike for golf shoes proposed herein has a quench-hardened metal plate, an upper face of which is of a concave configuration to form a base plate of a washer-shape like a dish. A periphery of the base plate is made integral with a plurality of tooth-shaped lugs that are arranged at regular angular intervals and bent downwards. A central part of the base plate has an upright and fixable or fastenable columnar member having a male-threaded shank. The tooth-shaped lugs are tapered outwards relative to the base plate.

The base plate and the columnar member are separately manufactured, and the latter is caulked to firmly adjoin the former, enabling mass-production of the spike at a lowered cost. For this purpose, the following structure may be preferable.

Namely, a middle flange is formed integral with and disposed between the male threaded shank and a short end portion. A non-circular hole penetrating the central portion of the base plate has a serrated inner periphery so that the short columnar end portion inserted in the hole is then caulked to have its own outer serration in mesh with the serrated inner periphery. At the same time and as a result of such a caulking process, an end flange is formed at an extremity of the short columnar end portion. The end flange facing the middle flange and is of a shape corresponding thereto so that the non-circular hole's periphery is sandwiched by and between the two flanges, whereby the fastenable columnar member is fixedly secured to the base plate.

Furthermore, it is possible to form an extra pin protruding downwards from the central part of the plate when the columnar end portion is caulked. In addition, pawls may be formed in the base plate by opening up the portions located around the base plate central portion, wherein each pawl extending in a circular direction is slanted in such a fashion that the base plate is prevented from loosening.

THE PREFERRED EMBODIMENTS

Figure 1:
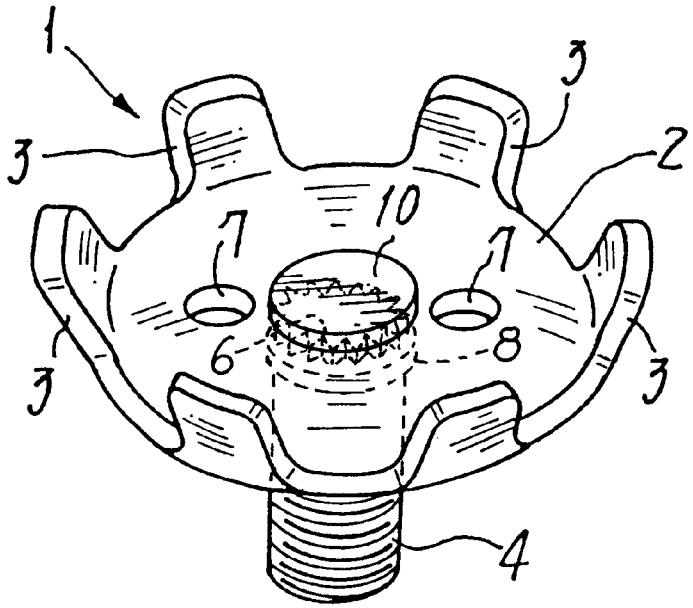
FIG. 1 is a perspective view of a spike for golf shoes, wherein the spike is shown in its position reversed upside down (in the drawings, for convenient description), with the spike being provided in an embodiment of the present invention.

Now some embodiments of the present invention will be described referring to the drawings, in which FIG. 1 shows a spike 1 to be secured on golf shoes (not shown). This spike 1 is composed of a generally round base plate 2 and a fastenable columnar member 4 having a male threaded portion integral therewith. The base plate 2, that is one of main parts of the spike, is formed integral with a plurality of tooth-shaped lugs 3. The columnar member 4 disposed at a central region of the base plate 2 protrudes upwards therefrom and away from a top face thereof.

Figure 2:
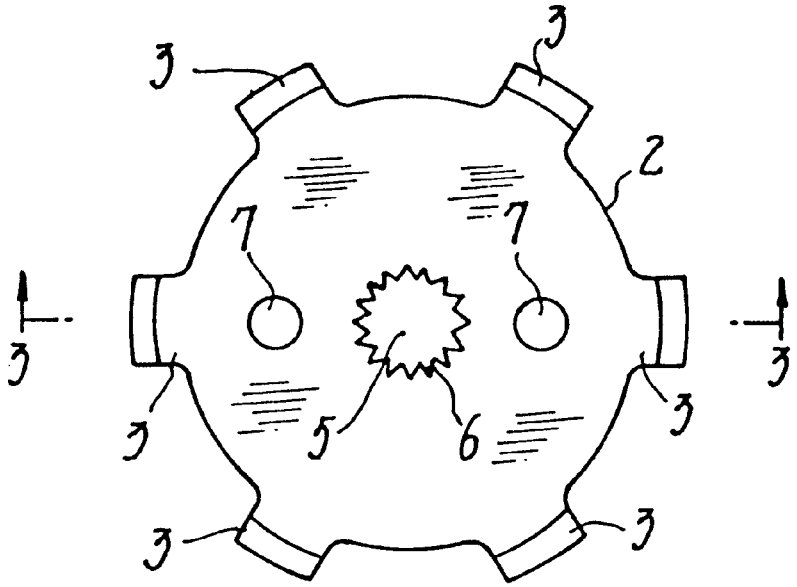
FIG. 2 is a plan view of a base plate as one of the main parts of the spike.
Figure 3:
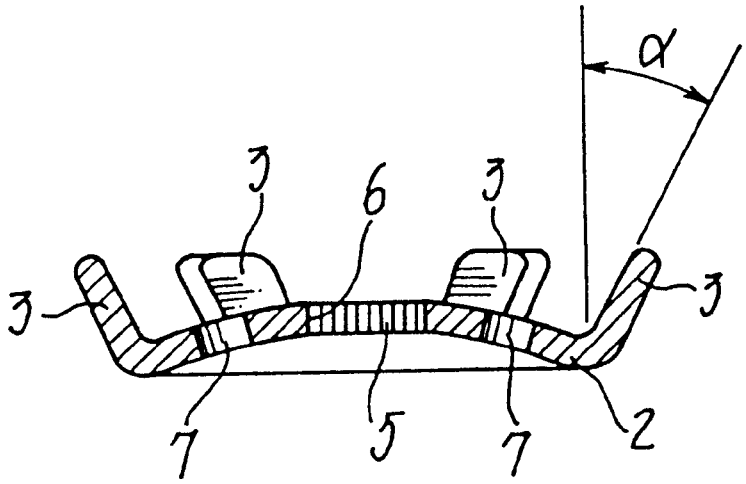
FIG. 3 is a cross section taken along the line 3—3 in FIG. 2.

The round base plate 2 is made of a carbon steel by the pressing process and a subsequent quench-hardening process. FIGS. 2 and 3 show that an upper side of the plate 2 is of a concave shape resembling a dish-shaped washer. The periphery of the base plate is formed integral with a plurality of tooth-shaped lugs 3 that are bent downwards. Those tooth-shaped lug 3 are formed at regular angular intervals and still tapered downwards and outwards at an angle ($\alpha$) of about 15 degrees relative to the base plate 2. Opposite lower free corners of each tooth-shaped lug are slightly rounded. The preferable number of the tooth-shaped lugs 3 is from six (6) to twelve (12). Desirable shape and size of each lug 3 depend on the number of thereof. As an example shown in the drawings, each lug is of a generally rectangular shape having a width of about 3.2 mm wide and a height of about 4.0 mm, for the base plate 2 having a diameter of about 20 mm. A hole 5 for receiving the fastenable member 4 having a male-threaded shank penetrates a central part of the base plate 2. The periphery of the hole 5 of a non-circular cross section is serrated to have a number of knurled grooves 6. In addition, round apertures 7 formed in the base plate 2 and engageable with fingers of a fastening tool are spaced diametrically across the central hole 5.

Figure 4:
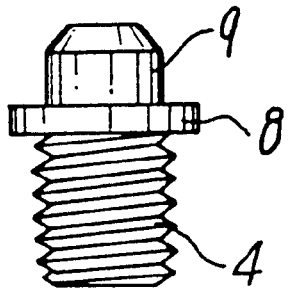
FIG. 4 is a front elevation of a fastenable member as the other main part.
Figure 5:
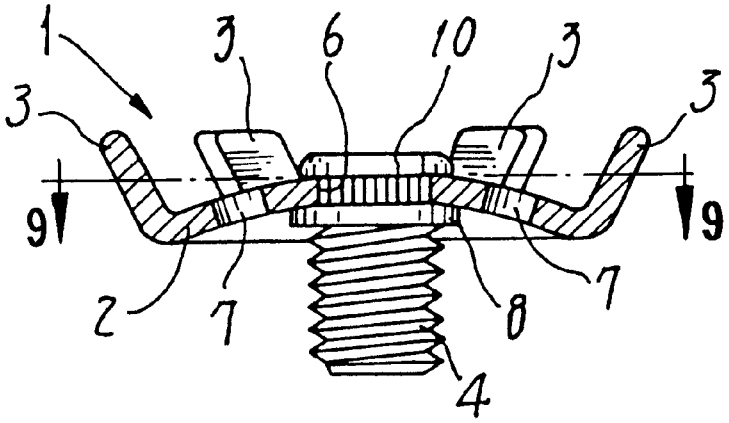
FIG. 5 is a front elevation of those main parts shown partly in vertical cross section and a a state in which they are fixed to each other.
Figure 9:
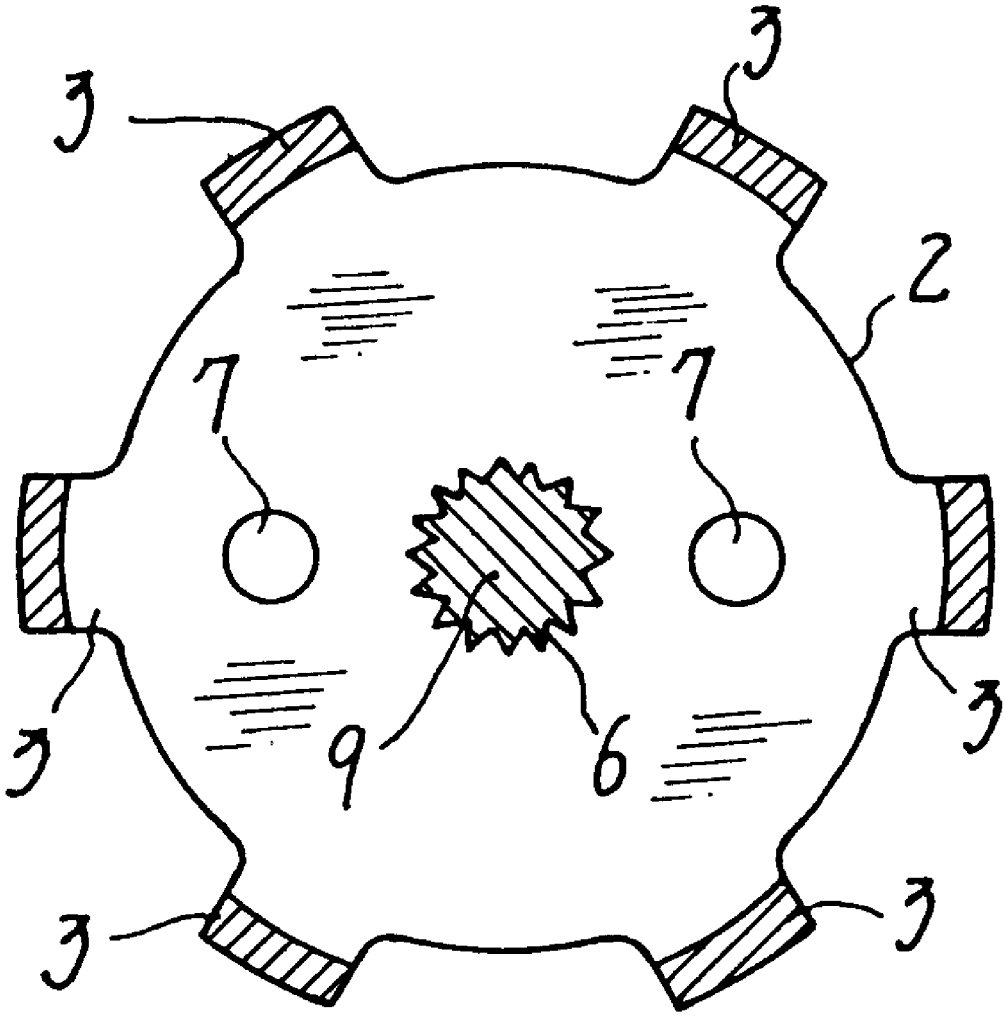
FIG. 9 is a cross section taken along the line 9—9 in FIG. 5.

The fastenable member 4 having the male-threaded shank, as shown in FIG. 4, has a middle flat flange 8 integral therewith and disposed adjacent to the lower end of member 4. This flat flange 8 continues to a columnar end portion 9 that is somewhat smaller than the flange in diameter. This flange's diameter is almost equal to an inner diameter of the hole 5 formed in and through the base plate 2. As will be seen in FIG. 5 and FIG. 9, the end portion 9 is inserted into the hole 5 and caulked to have an outer serration in mesh with the serrated inner periphery 6. Simultaneously with the formation of the outer serration, an end flange 10 is formed at the very end of the end portion 9. Thus, the base plate 2 is sandwiched by and between the flange 8 and the newly formed end flange 10 corresponding thereto. In this way, the fastenable member 4 having the shank is fixedly secured to the base plate 2 so as to jut therefrom. It is also desirable to design the middle flange 8 to be of such a thickness that it does not protrude out of an upper concave space defined in the dish-shaped base plate 2.

Figure 6:
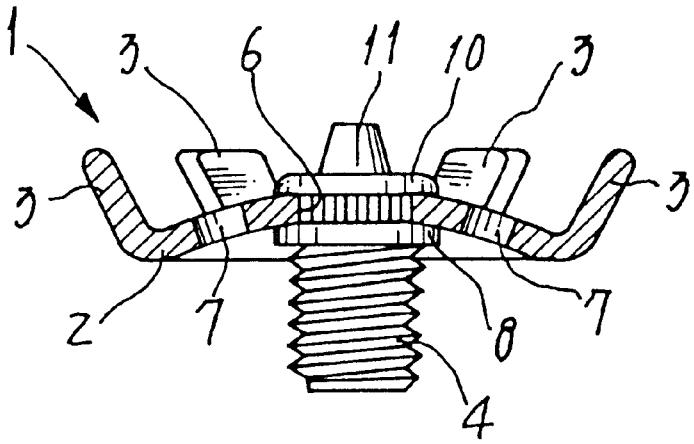
FIG. 6 is likewise a front elevation of main parts of a spike provided in another embodiment, the main parts being also a base plate and a fastenable member that are shown partly in vertical cross section and in a state in which they are fixed to each other.

As shown in FIG. 6, it is possible to form a short spike pin 11 when caulking the end portion 9. This spike pin 11 protruding from the central part of the base plate 2 is integral with the end flange 10. By virtue of synergism, such a caulked spike pin 11 cooperative with a plurality of the tooth-shaped lugs will enhance the ground-gripping force of the present spike.

Figure 7:
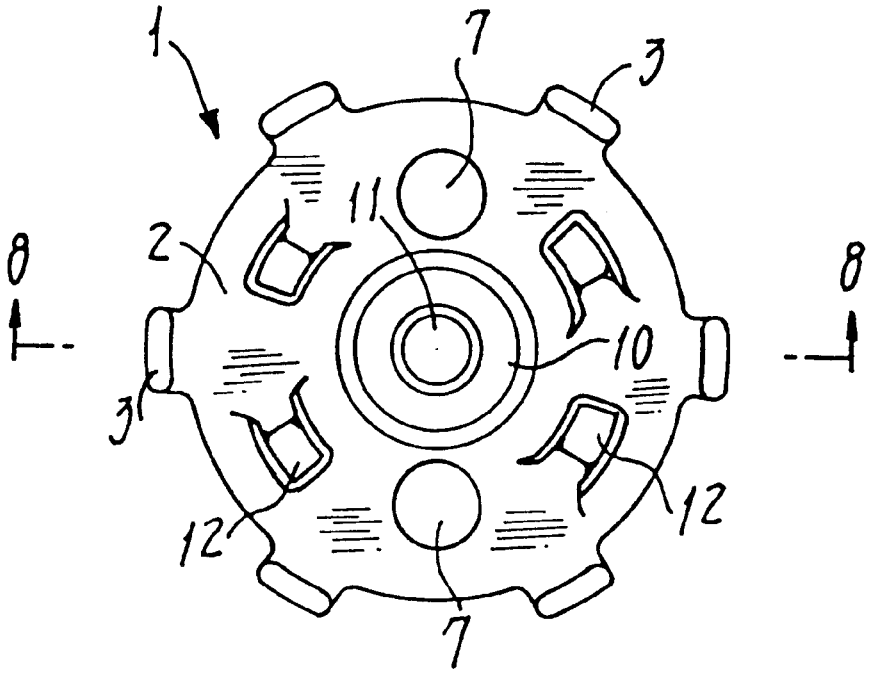
FIG. 7 is a plan view of the spike for golf shoes, provided in a further embodiment of the present invention.
Figure 8:
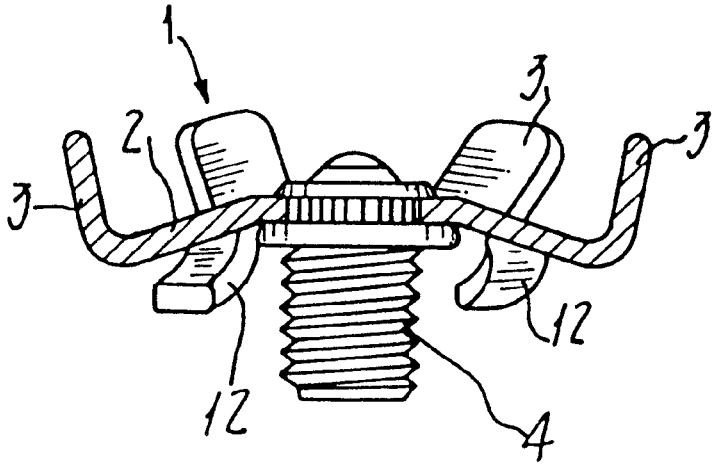
FIG. 8 a cross section taken along the line 8—8 in FIG. 7.

Additionally, FIGS. 7 and 8 show plural pawls 12 which are formed in the base plate 2 by opening up portions thereof surrounding the central hole. Each pawl 12 extends in a circular direction and is slanted such that the spike body 1 is prevented from loosening during use of the golf shoes.

Although other possible means than caulking to connect the base plate 2 to the fastenable member having the male-threaded shank could be employed, the caulking as discussed above in this embodiment will not only enable mass production of both the base plate 2 and the male-threaded shank 4, but also will facilitate automation of the caulking process. Thus, an overall manufacture cost will be lowered to a noticeable and advantageous extent.

The spike 1 of the present invention, made by caulking the male-threaded shank 4 to be fixed on the base plate 2 and having a plurality of the tooth-shaped lugs 3 tapered outwards and downwards, has an improved ground-engaging force. The spike 1 will strongly grip the ground as tightly as the prior art metal spikes do which have each a single spike pin. The tooth-shaped lugs 3 are relatively short and formed integral with the outer annular zone of the base plate 2 at regular angular intervals, which prevent the present spike from scratching and damaging the putting green. Also, the present spike will not give shoes-users any feeling of upward reaction of the ground against their soles. The tooth-shaped lugs 3 tapered outwards relative to the base plate 2, so that a lump of earth otherwise tending to stick to the lower face of base plate will slip off therefrom smoothly and automatically. The spike will now be protected well from being clogged with earth so as to maintain the enhanced ground-gripping force. In this embodiment, a carbon steel is used for making the base plate 2 and the male-threaded shank 4. However, any other appropriate metallic materials such as a titanium alloy may be used.

In summary, the present spike for golf shoes has a quench-hardened metal plate, as one of the main parts of the spike, which is formed integral with a plurality of tooth-shaped lugs. Due to this feature, the present spike is improved in its abrasion-resistance and durability. Still more, a number of tooth-shaped lugs disposed on the periphery of a base plate are tapered downwards and outwards. Thus, the spike will now hardly damage the putting green in spite of its strong ground-engaging force.

What is claimed is:

1. A spike for golf shoes comprising:

a base plate formed of a quench-hardened metal plate and having a concave upper face to be fixed on a shoe-sole, the base plate having a generally round periphery;

a plurality of lugs integral with the base plate, disposed at regular angular intervals and bent downwards; and a fastenable columnar member having a male-threaded shank protruding from a lower face of the base plate at a central part of the base plate, the columnar member having a middle flange adjacent the male-threaded shank, an end flange spaced from the middle flange and a short columnar portion between the middle flange and the end flange, the short columnar portion having an outer serration matching an inner serrated periphery of a hole formed at a central part of the base plate, the short columnar portion being provided within the hole, and the base plate being sandwiched between the end flange on the upper face of the base plate and the middle flange on the lower face of the base plate.

2. A spike as defined in claim 1, wherein the tooth-shaped lugs are downwards and outwards relative to the base plate.

3. A spike as defined in claim 1, further comprising a spike pin protruding downwards from the end flange at the central part of the base plate.

4. A spike as defined in claim 1 or 2, wherein pawls are formed in the base plate by opening up the portions surrounding the hole, such that the pawls extend in a circular direction and are slanted in order to prevent the spike from loosening.

5. A spike as defined in claim 3, wherein pawls are formed in the base plate by opening up the portions surrounding the hole, such that the pawls extend in a circular direction and are slanted in order to prevent the spike from loosening.

6. A spike as defined in claim 1, wherein the lugs have a generally rectangular shape.

* * * * *